US011373511B2

(12) United States Patent
Bowe, Jr. et al.

(10) Patent No.: US 11,373,511 B2
(45) Date of Patent: Jun. 28, 2022

(54) ALARM PROCESSING AND CLASSIFICATION SYSTEM AND METHOD

(71) Applicant: PureTech Systems Inc., Phoenix, AZ (US)

(72) Inventors: Larry J. Bowe, Jr., Phoenix, AZ (US); Monroe M. Thomas, Toronto (CA); Marvin Wade Barnes, Peoria, AZ (US); Andrew Giles Tillman, Bloomington, MN (US); Brant Buchika, Punta Gorda, FL (US)

(73) Assignee: PureTech Systems Inc., Phoenix, AZ (US)

( * ) Notice: Subject to any disclaimer, the term of this patent is extended or adjusted under 35 U.S.C. 154(b) by 0 days.

(21) Appl. No.: 17/474,931

(22) Filed: Sep. 14, 2021

(65) Prior Publication Data

US 2022/0084389 A1 Mar. 17, 2022

Related U.S. Application Data

(60) Provisional application No. 63/077,830, filed on Sep. 14, 2020.

(51) Int. Cl.
*G08B 25/00* (2006.01)

(52) U.S. Cl.
CPC ..... *G08B 25/001* (2013.01); *G08B 25/008* (2013.01)

(58) Field of Classification Search
CPC ..... G08B 25/001; G08B 25/008
See application file for complete search history.

(56) References Cited

U.S. PATENT DOCUMENTS

| | | | |
|---|---|---|---|
| 892,012 | A | 6/1908 | Schwartz |
| 7,855,654 | B2 | 12/2010 | Katz |
| 7,916,944 | B2 | 3/2011 | Yang et al. |
| 8,253,797 | B1 | 8/2012 | Maali et al. |
| 8,599,261 | B1 | 12/2013 | Maali |
| 8,659,661 | B2 | 2/2014 | Frank et al. |
| 8,929,603 | B1 | 1/2015 | Maali et al. |
| 9,213,904 | B1 | 12/2015 | Maali et al. |
| 9,292,743 | B1 | 3/2016 | Maali et al. |
| 9,367,748 | B1 | 6/2016 | Maali et al. |

(Continued)

OTHER PUBLICATIONS

Bochocskiy, Alexey; Wang, Chien-Yao; Liao, Hong-Yuan Mark; YOLOv4: Optimal Speed And Accuracy of Object Detection; arXiv:2004.10934v1 [cs.CV] Apr. 23, 2020.

(Continued)

*Primary Examiner* — Ojiako K Nwugo
(74) *Attorney, Agent, or Firm* — Thomas W. Galvani, P.C.; Thomas W. Galvani

(57) ABSTRACT

A system and method for processing alarms includes receiving alarm data from a third-party data source, the alarm data having visual data, an area of interest, and a sought target. The system processes the visual data to detect an object in the area of interest, and then classifies the object either in conformance with the sought target or in nonconformance with the sought target. The system issues a positive alarm when the object is in conformance with the sought target, and issuing issues a false alarm when the object is in nonconformance with the sought target. Feedback is received from the third-party data source regarding an accuracy of the respective positive alarm and the false alarm.

19 Claims, 3 Drawing Sheets

(56) References Cited

U.S. PATENT DOCUMENTS

| | | | | |
|---|---|---|---|---|
| 9,471,845 | B1 | 10/2016 | Maali et al. | |
| 9,569,671 | B1 | 2/2017 | Maali et al. | |
| 9,652,860 | B1 | 5/2017 | Maali et al. | |
| 9,936,169 | B1 | 4/2018 | Maali et al. | |
| 10,922,552 | B2 | 2/2021 | Maali et al. | |
| 11,126,857 | B1 | 9/2021 | Maali | |
| 2002/0030741 | A1 | 3/2002 | Broemmelsiek | |
| 2003/0091228 | A1 | 5/2003 | Nagaoka et al. | |
| 2005/0097479 | A1 | 5/2005 | Takabe et al. | |
| 2007/0230743 | A1 | 10/2007 | Mannerheim et al. | |
| 2008/0043572 | A1 | 2/2008 | Hansen et al. | |
| 2009/0096867 | A1 | 4/2009 | Skjeiten et al. | |
| 2009/0324010 | A1* | 12/2009 | Hou | G06K 9/00771 382/103 |
| 2010/0245589 | A1 | 9/2010 | Sun et al. | |
| 2010/0309315 | A1 | 12/2010 | Hogasten et al. | |
| 2012/0182173 | A1* | 7/2012 | Martone | G01S 13/9029 342/93 |
| 2012/0224063 | A1 | 9/2012 | Terre et al. | |
| 2012/0229282 | A1 | 9/2012 | Zagami et al. | |
| 2013/0044951 | A1 | 2/2013 | Cherng et al. | |
| 2013/0169809 | A1 | 7/2013 | Grignan et al. | |
| 2013/0176430 | A1 | 7/2013 | Zhu | |
| 2013/0251194 | A1 | 9/2013 | Schamp | |
| 2013/0293708 | A1 | 11/2013 | Garoutte | |
| 2013/0328867 | A1 | 12/2013 | Jung et al. | |
| 2014/0168065 | A1 | 6/2014 | Huang et al. | |
| 2014/0211988 | A1* | 7/2014 | Fan | G06T 7/248 382/103 |
| 2014/0240466 | A1 | 8/2014 | Holz et al. | |
| 2014/0270537 | A1 | 9/2014 | Lo Hok et al. | |
| 2014/0294361 | A1 | 10/2014 | Acharya et al. | |
| 2015/0104066 | A1 | 4/2015 | Shellshear et al. | |
| 2016/0203371 | A1 | 7/2016 | Tyagi et al. | |
| 2016/0232411 | A1 | 8/2016 | Krishnamoorthy et al. | |
| 2016/0379074 | A1 | 12/2016 | Nielsen et al. | |
| 2017/0103627 | A1* | 4/2017 | Wu | G08B 13/19613 |
| 2020/0401791 | A1* | 12/2020 | Gao | G06K 9/00255 |

OTHER PUBLICATIONS

Chris Stauffer, et al., Learning Patterns of Activity Using Real-Time Tracking, IEEE Transactions on Pattern Analysis and Machine Intelligence, Aug. 2000, pp. 747-757, vol. 22No. 8.

Eveland et al., "Background Modeling for Segmentation of Video-Rate Stereo Sequences", IEEE publication, Jun. 1996Bib sheet + 6 pages of article.

Lawrence R. Rabiner, A Tutorial on Hidden Markov Models and Selected Applications in Speech Recognition, Proceedings of the IEEE, Feb. 1989, pp. 257-286, vol. 77No. 2.

Redmon,Joshua; Farhadi, Ali; YOLOv3: An Incremental Improvement; arXiv:1804.02767v1 [cs.CV] Apr. 8, 2018.

Ren, Shaoqing; He, Kaiming; Girchick, Ross; Sun, Jian; Faster R-CNN: Towards Real-Time Object Detection with Region Proposal Networks; arXiV:1506.01497v3 [cs:CV] Jan. 6, 2016.

Venkatesh. "Fast Bounding Box Estimation based on Face Detection" Idiap Research Institute, (MULTI, 200020-122062). 2010.

Wojke, Nicolai; Bewly, Alex; Paulus, Dietrich; Simple Online and Realtime Tracking With A Deep Association Metric; arXiv:1703.07402v1 [cs.CV] Mar. 21, 2017.

* cited by examiner

ALARM PROCESSING AND CLASSIFICATION SYSTEM AND METHOD

CROSS-REFERENCE TO RELATED APPLICATIONS

This application claims the benefit of U.S. Provisional Application No. 63/077,830, filed Sep. 14, 2020, which is hereby incorporated by reference.

FIELD

The present invention relates generally to security systems, and more particularly to alarm monitoring of security systems.

BACKGROUND

The alarm and security industry has traditionally been dominated by large service providers dependent on sales teams, installation technicians, service trucks, and phone banks—all hallmarks of a labor-intensive business. The recent entrance of communication and technology companies disrupted this industry and provided increased access and lower costs to end customers. Devices are now built and programmed to be easier to install, easier to use, and easier to monitor. Generally, this disruption has been a benefit to customers.

Most security systems—both conventional and more tech-heavy ones—now use some sort of motion-activated camera. Unfortunately, the software for detecting motion is fairly primitive and results in a high false alarm rate. These systems often generate false alarms when used in outdoor scenes or in situations where variable lighting and other environmental conditions exist. Almost any event can trigger an alarm, whether it is a person walking past a security camera, a cat scampering in front of a doorbell camera, or rustling trees detected by a backyard camera. Some of these events are false alarms, reported directly to the customer or their alarm monitoring company.

False alarms are an annoyance to end customers when they receive them directly. Customers may have to frequently check their video record or may even call their monitoring service to inquire regarding the alarm. For monitoring service companies, the aggregate effect of this increase in false alarms can overwhelm the staff that processes alarms and check-in calls, rendering their services nearly impossible to provide quickly and accurately. An improved manner of analyzing these alarms is needed. If dispatched, law enforcement routinely charges businesses and individuals for erroneous alarms that cause them to waste time investigating false alarms, which also takes time away from actual events that need their attention.

SUMMARY

In an embodiment, a system and method for processing alarms includes receiving alarm data from a third-party data source. The alarm data includes visual data, an area of interest, and a sought target. The system processes the visual data to detect an object in the area of interest, and classifies the object either in conformance with the sought target or in nonconformance with the sought target. The system issues a positive alarm when the object is in conformance with the sought target, and issues a false alarm when the object is in nonconformance with the sought target. The system receives feedback from the third-party data source regarding an accuracy of the respective positive alarm and the false alarm.

In some embodiments, the step of processing the visual data includes executing a convolutional neural network on the visual data in the area of interest. In some embodiments, the step of processing the visual data includes processing the visual data at a predetermined frame rate. In some embodiments, the positive alarm includes alarm characteristics such as a time, date, camera name, and site name. In some embodiments, the system alters the step of classifying the visual data, in response to receiving the feedback from the third-party data source. In some embodiments, the system ends the method when resources for the step of classifying outweigh a priority level assigned to the alarm data.

In an embodiment, a system and method for processing alarms includes receiving alarm data from a third-party data source. The alarm data includes visual data, an area of interest, and a sought target. The system processes the visual data to detect an object in the area of interest, and classifies the object either in conformance with the sought target or in nonconformance with the sought target. The system issues a return signal in response to classifying the object, wherein the return signal is a positive alarm when the object conforms with the sought target, and is a false alarm when the object does not conform with the sought target. The system receives feedback from the third-party data source regarding an accuracy of the return signal.

In some embodiments, the step of classifying the object includes executing a convolutional neural network on the visual data in the area of interest. In some embodiments, the step of processing the visual data includes processing the visual data at a predetermined frame rate. In some embodiments, the positive alarm includes alarm characteristics include a time, date, camera name, and site name. In some embodiments, the system alters the step of classifying the object, in response to receiving the feedback from the third-party data source. In some embodiments, the system ends the method when resources for the step of classifying outweigh a priority level assigned to the alarm data.

In an embodiment, a method for processing alarms includes receiving alarm data from a third-party data source. The alarm data includes visual data, an area of interest, and a sought target. The system processes the visual data to detect an object in the area of interest, and classifies the object either in conformance with the sought target or in nonconformance with the sought target. The system issues a positive alarm when the object is in conformance with the sought target.

In some embodiments, the system receives feedback from the third-party data source regarding an accuracy of the positive alarm. In some embodiments, the step of receiving feedback further includes receiving feedback regarding an accuracy of the positive alarm. In some embodiments, the system issues a false alarm when the object is in nonconformance with the sought target. In some embodiments, the step of classifying the object includes executing a convolutional neural network on the visual data in the area of interest. In some embodiments, the step of processing the visual data includes processing the visual data at a predetermined frame rate. In some embodiments, the positive alarm includes alarm characteristics such as a time, date, camera name, and site name. In some embodiments, the system alters the step of classifying the object, in response to receiving feedback from the third-party data source regarding an accuracy of the positive alarm. In some embodiments, the system ends the method when resources for the step of classifying outweigh a priority level assigned to the alarm data.

The above provides the reader with a very brief summary of some embodiments described below. Simplifications and omissions are made, and the summary is not intended to limit or define in any way the disclosure. Rather, this brief summary merely introduces the reader to some aspects of some embodiments in preparation for the detailed description that follows.

BRIEF DESCRIPTION OF THE DRAWINGS

Referring to the drawings.

DETAILED DESCRIPTION

Figure 1:
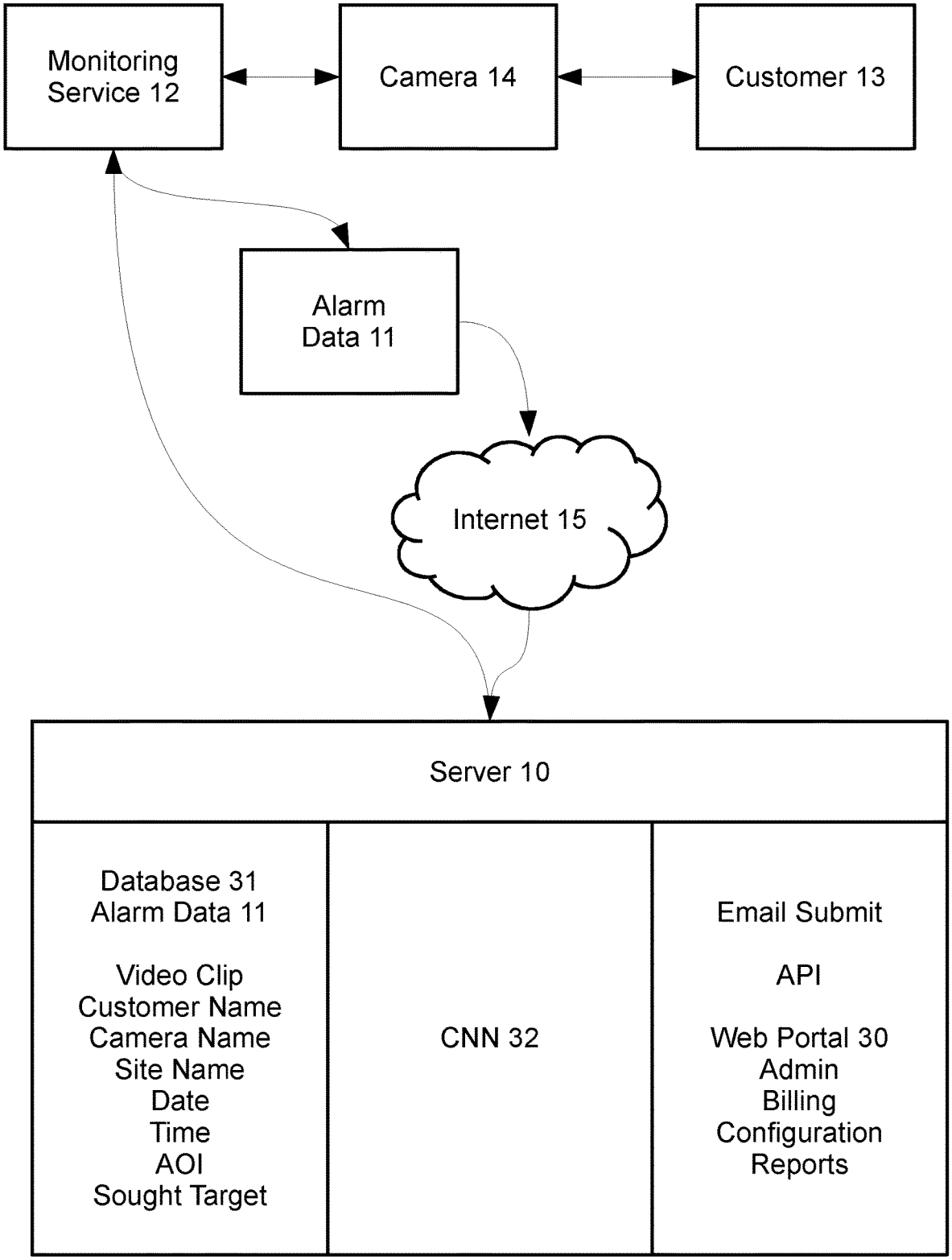
FIG. 1 is a generalized schematic of an alarm processing and classification system.

Reference now is made to the drawings, in which the same reference characters are used throughout the different figures to designate the same elements. Briefly, the embodiments presented herein are preferred exemplary embodiments and are not intended to limit the scope, applicability, or configuration of all possible embodiments, but rather to provide an enabling description for all possible embodiments within the scope and spirit of the specification. Description of these preferred embodiments is generally made with the use of verbs such as "is" and "are" rather than "may," "could," "includes," "comprises," and the like, because the description is made with reference to the drawings presented. One having ordinary skill in the art will understand that changes may be made in the structure, arrangement, number, and function of elements and features without departing from the scope and spirit of the specification. Further, the description may omit certain information which is readily known to one having ordinary skill in the art to prevent crowding the description with detail which is not necessary for enablement. Indeed, the diction used herein is meant to be readable and informational rather than to delineate and limit the specification; therefore, the scope and spirit of the specification should not be limited by the following description and its language choices.

FIG. 1 illustrates a server 10 for receiving alarm data 11 from a monitoring service 12 that collects the alarm data 11 from its plurality of customers 13 and their cameras 14. The server 10 processes and classifies the alarm data 11 to determine whether the alarm data 11 presents a positive alarm or a false alarm. Positive alarms are returned to the monitoring service 12 for more accurate reporting to the customer 13 and dispatch of law enforcement. False alarms are not reported. Monitoring services 12 and customers 13 that subscribe to the system 8 thus ensure that positive alarms returned from the server 10 are more reliable than alarms otherwise triggered by the cameras 14, and that false alarms are much less likely to occur. The system 8 operates a method 9 (shown in FIG. 3) which leverages user-provided input, image processing, and a convolutional neural network to distinguish between positive alarms and false alarms with great accuracy that improves with use.

In conventional systems, a triggering event immediately causes an alarm to the monitoring service and customer. The alarm is issued either by the hardware on the customer's premises or by the monitoring services after receiving notification of the triggering event from the camera or other device at the customer's premises. Many of these alarms are false alarms. Interposition of the server 10 between the camera and the monitoring service and the customer reduces the number of false alarms.

Typically, the customer 13 is a residential or commercial person or entity monitoring his real property. In this description, the pronouns "he," "him," and "his" are used to identify the customer 13, whether or not the customer 13 is male, female, corporate entity, organization, or otherwise; a customer 13 is an account which has subscribed to the monitoring service 12. Before or after the customer 13 subscribes to the monitoring service 12, the monitoring service 12 makes a camera 14 available to the customer 13 for use in monitoring his property. The term "camera" is used herein as a generic term which encompasses, without limitation, imaging devices such as still cameras, video cameras, motion detectors, contact closures, fence sensors, radar, lidar, and other like sensors.

The customer 13 positions the camera 14 or cameras 14 to image a space of interest, such as an entryway, a window, a vehicle gate, a parking lot, a property fence line, a valuable storage space, or the like. The customer 13 energizes the camera 14 and then connects it in data communication to the Internet 15, such as through a wired or Wi-Fi network at the customer 13 premises. The customer 13 then registers the camera 14 with the monitoring service 12 through whatever existing method the monitoring service 12 requires of its customers 13. Once this registration is concluded, the monitoring service 12 has collected certain information about the customer 13 and the camera 14. That information preferably includes, but is not limited to, the customer name or unique identifier, a camera name or unique identifier, and a name or unique identifier of the imaged space or site. The monitoring service 12 stores this information in a database 31 for aggregation as part of the alarm data 11 when such alarm data 11 is transmitted to the server 10.

Figure 2:
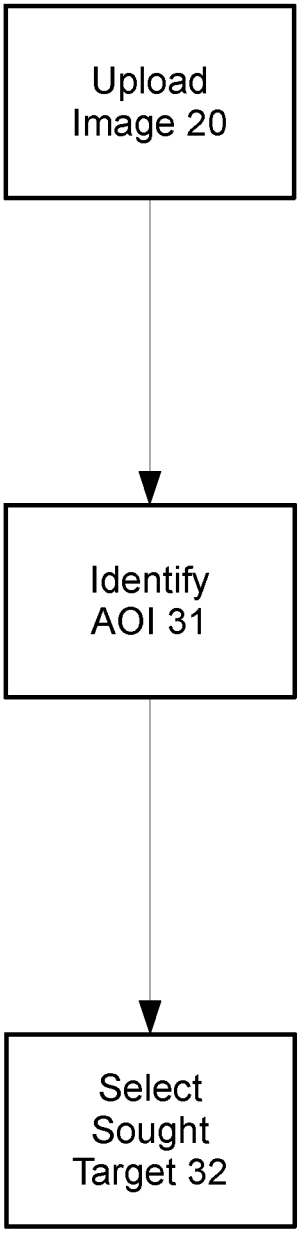
FIG. 2 is a generalized schematic of steps of an alarm processing and classification method.

The customer 13 then conducts a setup with the server 10. Turning briefly to FIG. 2, setup preferably includes three steps. At step 20, the customer 13 uploads an image to the server 10. The customer 13, having previously positioned the camera 14 to image the space of interest, records a video of the space. Preferably, the customer 13 is logged into a web portal 30 of the server 10 so that the customer 13 can interact with a customer account, can view on a screen information displayed about the customer account, and can upload or download files to and from the customer account. The customer 13 uploads the recorded video to the server 10, and a still image from the video is selected. The web portal 30 of the server 10 displays this still image to the customer 13 and requests that the customer 13 identify an area of interest ("AOI"). The AOI is the image space that the customer 13 wishes to monitor.

The customer 13 draws a polygon around the AOI to identify it as the AOI, as in step 21. For example, the customer 13 may desire to monitor people walking into and out of the rear door of an automobile repair shop, and so will draw a polygon around the door. Or, as another example, the customer 13 may desire to monitor vehicle traffic on a private road, and so the customer 13 will draw a polygon across the width of the road. Drawing the polygon defines the AOI. In some embodiments, the AOI is stored with the still image in a database 31 of the server 10. In other embodiments, the still image and AOI are transmitted to the server 10 each time an alarm is triggered.

Once the AOI is identified, the server 10 prompts the customer 13 to identify a sought target, as in step 22. A sought target is the type of object that the customer 13 wishes to monitor. If the customer 13 cares only about human traffic, he selects the option corresponding to "person." If the customer 13 cares only about vehicular traffic, he selects the option corresponding to "vehicle." In some embodiments, the sought target is stored in the database 31 of the server 10. In other embodiments, the sought target is transmitted to the server 10 each time an alarm is triggered, as part of the alarm data 11.

The system 8 runs on and includes a server 10, or collection of servers, operating remotely, such as through the cloud. The monitoring services 12 communicate in data transmission with the server 10 through the Internet 15. Each server 10 of the system 8 is a specially-programmed computer having at least a processor or central processing unit ("CPU"), non-transitory memory such as RAM and hard drive memory, hardware such as a network interface card and other cards connected to input and output ports, and software specially-programmed to host the system 8 and process and respond to requests from the monitoring services 12.

Figure 3:
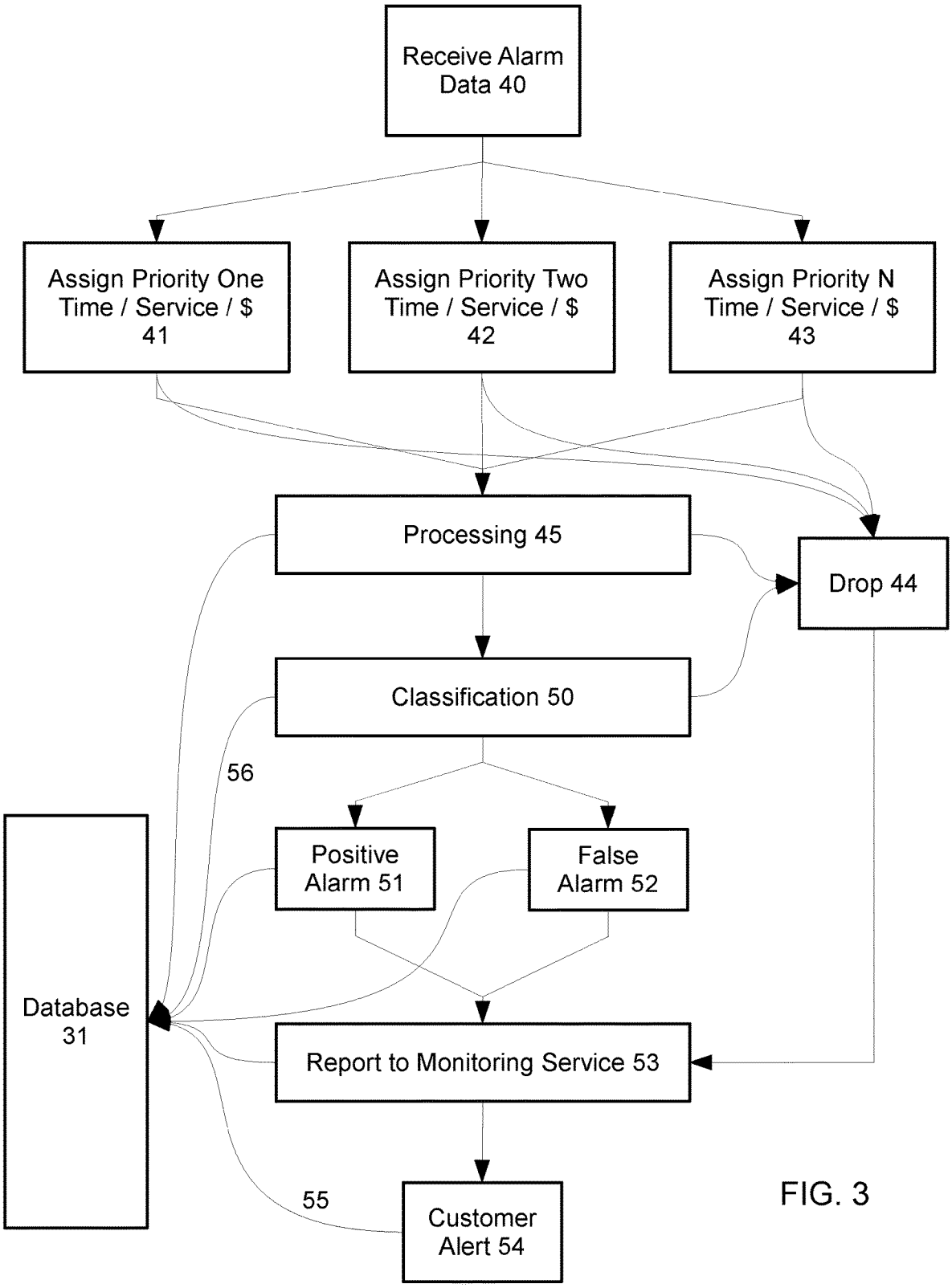
FIG. 3 is a generalized schematic of further steps of the alarm processing and classification method.

Turning now to FIG. 3, the method 9 of operation of the system 8 is shown. The system 8 receives alarm data 11 at step 40 in response to a triggering event. A triggering event is any event, incident, or action detected by the camera 14 of the customer 13 sufficient to potentially trigger an alarm. For example, a triggering event may be a person crawling through an AOI, or a tree branch waving in an AOI. The camera 14 records visual data in the form of a video clip of the triggering event. Generally, the camera 14 records continuously to a DVR which is either on site or is remotely hosted by the monitoring service 12. The video clip preferably captures the triggering event as well as periods of time before and after the triggering event.

The camera 14 transmits this video clip to the monitoring service 12 which, in turn, transmits the alarm data 11 to the server 10. As such, the monitoring service 12, customer 13, and camera 14 are each third-party sources of the alarm data 11 to the server 12. The alarm data 11 includes the video clip, as well as the certain information previously collected about the customer 13 and the camera 14, such as the customer name or unique identifier, camera name or unique identifier, and a name or unique identifier of the imaged space or site. The alarm data 11 also includes a date and time of the triggering event. Moreover, the alarm data 11 includes the AOI and sought target previously identified by the customer 13.

The server 10 receives the alarm data 11. The server 10 may receive the alarm data 11 in a variety of manner. In one manner, the monitoring service 12, or the camera 14 directly, sends an email to the server 10 with the video clip attached. The server 10 is programmed such that, upon receiving the email, the processor executes instructions to parse and extract the video clip, site name, camera name, and other alarm data 11 from the email and store it in the database 31 for assignment and processing. In another manner, the monitoring service 12 connects to the server 10 through an API and transmits the alarm data, including the video clip and other information. The server 10 again stores that information in the database 31 for assignment and processing. Under all methods, the information stored in the database 31 is used both for processing, for later auditing, and for later deep learning as part of a zoo for training the convolutional neural network.

The system 8 maintains multiple priority queues or "classes of service" associated with slower or quicker processing times for the alarm data 11. These queues are shown as priority one queue 41, priority two queue 42, and priority N queue 43, representing a plurality of queues. These queues accord different processing priorities to alarm data 11 sourced from monitoring services 12 that have different importance levels or security concerns, have paid different amounts, have placed different time restrictions on processing, or have other service preferences. For example, some monitoring services 12 might pay at a higher pricing tier to receive preferential or priority processing, and a load balancer in the server 10 correspondingly assigns alarm data 11 from that monitoring service 12 to a higher priority queue. In some instances, the alarm data 11 contains a time restriction defining a maximum amount of time for the system 8 to process the alarm data 11, and the system 8 assigns the alarm data to a particular queue based on that constraint. Moreover, if the server 10 is oversubscribed and unable to accept the alarm data 11 because all priority queues are full, the alarm data is dropped at step 44, in which case an "insufficient resources" signal is sent back to the monitoring service 12 indicating that the alarm data was not processed, so that the monitoring service 12 may or may not pass the alarm on to the customer 13 as the monitoring service 12 determines. In other words, when resources required for processing or classifying the alarm data 11 outweigh the priority level assigned to the alarm data 11, the system 8 drops the alarm data 11, effectively ending subsequent substantive processing of the alarm data 11 in the method 9.

After being assigned to a priority queue, the server 10 preferably but optionally processes the alarm data 11, as shown in step 45 in FIG. 3. In the processing step 45, the processor executes coded instructions to extract the video clip from the alarm data 11, decode the video clip, and isolate a portion of the video clip. Individual image frames from the isolated portion of the video clip are processed separately at a selected frame rate. The frames are selected by the server 10 but may be differently configured by the customer 13 through the web portal 30. Additionally, the frame rate is selected by the server 10 (at preferably four frames per second) but also may be differently pre-determined or subsequently configured by the customer 13 through the web portal 30. Processing prepares the images for object classification.

Processing is the optional operation of separating image pixels into background and foreground, through multimodal background modelling, exploiting both intensity and gradient orientation. Each pixel in the image has a probability of being either background or foreground, and so a probability distribution is thus constructed for each pixel across a plurality of frames. This probability distribution governs the determination of each pixel as either background or foreground. Pixels which belong to the foreground and demonstrate cohesion as clustered pixels define a blob corresponding to an object in the image. Blobs are objects in the foreground and other pixels belong to the background. In other embodiments, the system 8 skips constructing a background model. Instead, such processing may be avoided when the convolutional neural network classifies the presence of a person or vehicle in the AOI.

The objects are classified at step 50. Classification uses a convolutional neural network ("CNN") 32. Each image is loaded into the CNN, which has been pre-trained for object identification on a very large data set. In some embodiments, the CNN draws a bounding box around each object, while in other embodiments, the system 8 returns the AOI provided by the customer 13. The bounding box has characteristics or appearance descriptors, including a location (such as a center position), a width and height (or an aspect ratio together with either a width or height), a classification ID, and a confidence score. The classification ID identifies the detected object type, such as a person, vehicle, tree, etc. The confidence score is a number between zero and one, and potentially inclusive thereof, where zero represents no confidence in the classification ID and one represents complete confidence in the classification ID. The CNN operates on the image in the AOI to produce the classification ID of the object.

The processor of the server 10, executing instructions coded in the memory of the server 10, then compares the sought target as provided by the customer 14 with the classification ID of the object to determine what kind of return signal should be issued. If the classification ID is in conformance with the sought target, then this indicates the triggering event was an actual event and requires a positive alarm to be issued. If the classification ID is not in conformance with the sought target, then this indicates the triggering event was not an actual event and a false alarm should be issued.

For example, if the sought target is a person and the CNN yields a classification ID of a person, the server 10 issues and logs a positive alarm 51. On the other hand, if the sought target is a vehicle and the CNN yields a classification ID of a person (or a tree, or other non-vehicle object), the server 10 issues and logs a false alarm 52. Thus, step 50 classifies the object as either a positive alarm 51 or a false alarm 52.

The server 10 also logs the false alarm 52 in the database 31 for later analysis, audit, or CNN training. The monitoring service 12 does not pass the false alarm 52 on to the individual at the monitoring service 12 responsible for reviewing alarms or to the customer 13, thereby avoiding a needless interruption to monitoring service personnel and the customer 13.

In the event of a positive alarm 51, however, the server 10 transmits positive alarm data to the monitoring service 12 at step 53. The positive alarm data includes the video clip, as well as alarm characteristics such as the date and time of the triggering event, the camera name, and the name of the imaged space or site. The monitoring service 12 then processes the positive alarm 51 and alerts the customer (step 54) in the same manner that it would had a true alarm come directly from the customer 13 or camera 14, and optionally dispatches law enforcement. The server 10 also logs the positive alarm 51 in the database 31 for later analysis, audit, or CNN training. The system 8 periodically generates a report providing information about the number of positive and false alarms 51 and 52.

The processing and classification steps 45 and 50 are restricted in time. As noted above, these steps occur through different priority queues. Some queues have time constraints. If processing 45 or classification 50 cannot be completed within a pre-determined time, or within a time configured by the customer 13, the system 8 ceases processing or classification and drops the clip (step 44), instead returning the alarm and an unprocessed signal to the monitoring service 12. The personnel at the monitoring service 12 will then need to manually view the alarm clip to determine if it is a real or false alarm. If processing or classification does yield such a drop at step 44, that action is logged in the database 31. The number of video clips that are dropped because of insufficient resources is a performance metric of the system 8 used to analyze and address system 8 health, system 8 performance, and resource expansion or re-allocation. All actions of the server 10 are logged to the database 31 for subsequent audit and analysis. The system 8 further gathers statistic regarding the number of alarms that are dropped versus those that are classified as either positive alarms or false alarms, the amount of time required for the system 8 to process the alarm data 11, the time required for the system 8 to process the alarm data 11 from receipt to notification of the monitoring service 12, and the total time required from the triggering event to notification of the monitoring service 12, and like metrics.

Analysis is performed both by the system 8 operator and by the customer 13. The web portal 30 provides a platform for the customer 13 to interact with the server 10. Through the web portal 30, a customer 13 manages administrative accounts and privileges, billing matters, setup, and configuration. Through configuration, the customer 13 can upload an image of the imaged space or site, draw a bounding box, identify the AOI, and identify a sought target. The customer 13 can also specifically identify regions of an AOI that, while contained within the AOI, are actually not important from a monitoring perspective, such as traffic on a street or a sidewalk in the background. The customer 13 can also identify or restrict analysis of a video clip to certain frames in the video clip, such as the middle fifty percent or all of the video clip but the leading and trailing two seconds.

In the web portal 30, the customer can also define a maximum queue time, so that the alarm data 11 is dropped and sent to the monitoring service 12 if the system 8 is unable to make a determination on the alarm data 11 within the maximum queue time. The customer 13 is also able to access its alarm history. He can view the times alarm data 11 was sent for his account. He can view past changes to his account, as well as past billings. He is able to access a report covering the number of positive alarms and the number of false alarms.

The customer 13 can also view or audit which video clips were processed and which classifications were assigned to the image frames of each clip. He then is able to provide feedback through the web portal 30 (indicated by the arrowed line 55 from step 54 to the database 31). He reports specific incorrect classifications or reports the accuracy or quality of the classifications. This feedback is recorded in the database 31 and is analyzed later and is also used for training the CNN. As shown by the double-arrowed line 56 between the database 31 and the classification step 50, the feedback provided to the database 31 is used as data to help further train the CNN so as to alter the step 50 of classification and improve the accuracy of object classification.

The system 8 additionally records all video clips and images from the alarm data 11 into the database 31 for machine learning and auditing. This information is useful in continuously training the CNN to improve its classification of objects.

A preferred embodiment is fully and clearly described above so as to enable one having skill in the art to understand, make, and use the same. Those skilled in the art will recognize that modifications may be made to the description above without departing from the spirit of the specification, and that some embodiments include only those elements and features described, or a subset thereof. To the extent that modifications do not depart from the spirit of the specification, they are intended to be included within the scope thereof.

What is claimed is:

1. A method for processing alarms, the method comprising:

receiving alarm data from a third-party data source, the alarm data comprising visual data, an area of interest, and a sought target;

processing the visual data to detect an object in the area of interest;

classifying the object either in conformance with the sought target or in nonconformance with the sought target;

issuing a positive alarm when the object is in conformance with the sought target, and issuing a false alarm when the object is in nonconformance with the sought target; and receiving feedback from the third-party data source regarding an accuracy of the respective positive alarm and the false alarm.

2. The method of claim 1, wherein the step of processing the visual data includes executing a convolutional neural network on the visual data in the area of interest.

3. The method of claim 1, wherein the step of processing the visual data includes processing the visual data at a predetermined frame rate.

4. The method of claim 1, wherein the positive alarm includes alarm characteristics comprising a time, date, camera name, and site name.

5. The method of claim 1, further comprising the step of altering the step of classifying the visual data, in response to receiving the feedback from the third-party data source.

6. The method of claim 1, further comprising the step of ending the method when resources for the step of classifying outweigh a priority level assigned to the alarm data.

7. A method for processing alarms, the method comprising:

receiving alarm data from a third-party data source, the alarm data comprising visual data, an area of interest, and a sought target;

processing the visual data to detect an object in the area of interest;

classifying the object either in conformance with the sought target or in nonconformance with the sought target;

issuing a return signal in response to classifying the object, wherein the return signal is a positive alarm when the object conforms with the sought target, and is a false alarm when the object does not conform with the sought target; and receiving feedback from the third-party data source regarding an accuracy of the return signal.

8. The method of claim 7, wherein the step of classifying the object includes executing a convolutional neural network on the visual data in the area of interest.

9. The method of claim 7, wherein the step of processing the visual data includes processing the visual data at a predetermined frame rate.

10. The method of claim 7, wherein the positive alarm includes alarm characteristics comprising a time, date, camera name, and site name.

11. The method of claim 7, further comprising the step of altering the step of classifying the object, in response to receiving the feedback from the third-party data source.

12. The method of claim 7, further comprising the step of ending the method when resources for the step of classifying outweigh a priority level assigned to the alarm data.

13. A method for processing alarms, the method comprising:

receiving alarm data from a third-party data source, the alarm data comprising visual data, an area of interest, and a sought target;

classifying an object in the area of interest either in conformance with the sought target or in nonconformance with the sought target;

issuing a positive alarm when the object is in conformance with the sought target;

ending the method when resources for the step of classifying outweigh a priority level assigned to the alarm data.

14. The method of claim 13, further comprising the step of receiving feedback from the third-party data source regarding an accuracy of the positive alarm.

15. The method of claim 14, wherein the step of receiving feedback further includes receiving feedback regarding an accuracy of the positive alarm.

16. The method of claim 13, further comprising the step of issuing a false alarm when the object is in nonconformance with the sought target.

17. The method of claim 13, wherein the step of classifying the object includes executing a convolutional neural network on the visual data in the area of interest.

18. The method of claim 13, wherein the positive alarm includes alarm characteristics comprising a time, date, camera name, and site name.

19. The method of claim 13, further comprising the step of altering the step of classifying the object, in response to receiving feedback from the third-party data source regarding an accuracy of the positive alarm.

* * * * *